US008662955B1

(12) United States Patent
Fai et al.

(10) Patent No.: US 8,662,955 B1
(45) Date of Patent: Mar. 4, 2014

(54) TOY FIGURES HAVING MULTIPLE CAM-ACTUATED MOVING PARTS

(75) Inventors: Chang K. Fai, Kowloon (HK); Edward Wong, Kowloon (HK); James Wong, Tsing Yi (HK)

(73) Assignee: Mattel, Inc., El Segundo, CA (US)

( * ) Notice: Subject to any disclaimer, the term of this patent is extended or adjusted under 35 U.S.C. 154(b) by 636 days.

(21) Appl. No.: 12/900,777

(22) Filed: Oct. 8, 2010

Related U.S. Application Data

(60) Provisional application No. 61/253,764, filed on Oct. 21, 2009, provisional application No. 61/250,474, filed on Oct. 9, 2009.

(51) Int. Cl.
*A63H 3/00* (2006.01)
*A63H 3/36* (2006.01)
*A63H 11/00* (2006.01)

(52) U.S. Cl.
USPC ..... 446/337; 446/353; 446/268

(58) Field of Classification Search
USPC ..... 446/268, 330, 337, 339, 342, 353, 391
See application file for complete search history.

(56) References Cited

U.S. PATENT DOCUMENTS

| | | | | | |
|---|---|---|---|---|---|
| 1,489,385 | A | * | 4/1924 | Ciavatti | 446/341 |
| 2,157,889 | A | | 5/1939 | Decker | |
| 2,250,916 | A | | 7/1941 | Magruder | |
| 2,378,190 | A | | 6/1945 | Cohen | |
| 2,633,669 | A | * | 4/1953 | Churus | 446/353 |
| 2,641,866 | A | * | 6/1953 | Schiller | 446/342 |
| 2,686,388 | A | * | 8/1954 | Seidl | 446/340 |
| 2,895,258 | A | | 7/1959 | Rabenau | |
| 2,996,304 | A | | 8/1961 | Lange | |
| 3,024,535 | A | | 3/1962 | Rabenau | |
| 3,053,009 | A | | 9/1962 | Ostrander | |
| 3,142,131 | A | | 7/1964 | Rabenau | |
| 3,195,268 | A | | 7/1965 | Neumann et al. | |
| 3,226,878 | A | | 1/1966 | Glass et al. | |
| 3,236,006 | A | | 2/1966 | Carroll | |
| 3,237,344 | A | | 3/1966 | Ostrander et al. | |
| 3,298,130 | A | | 1/1967 | Ryan | |
| 3,353,296 | A | | 11/1967 | Ryan et al. | |
| 3,364,618 | A | | 1/1968 | Ryan et al. | |
| 3,383,795 | A | * | 5/1968 | Ryan et al. | 446/304 |
| 3,406,482 | A | * | 10/1968 | Ryan et al. | 446/304 |
| 3,445,955 | A | | 5/1969 | Ryan et al. | |
| 3,455,052 | A | | 7/1969 | Gardel et al. | |
| 3,462,875 | A | | 8/1969 | May | |

(Continued)

FOREIGN PATENT DOCUMENTS

| | | |
|---|---|---|
| CA | 2023931 | 10/1991 |
| DE | 2917223 | 11/1980 |

(Continued)

*Primary Examiner* — Gene Kim
*Assistant Examiner* — Alyssa Hylinski
(74) *Attorney, Agent, or Firm* — Kolisch Hartwell, PC

(57) ABSTRACT

A toy figure is disclosed. In some embodiments, the toy figure may include a head; plural facial-expression structures movably mounted to the head and configured to move independent of each other; plural cams configured to rotate about a first axis and to move the plural facial-expression structures; and an elongate cam drive configured to rotate about a second axis spaced from the first axis, and to contact and rotate the plural cams about the first axis, the elongate cam drive having a constant outer diameter.

22 Claims, 4 Drawing Sheets

(56) References Cited

U.S. PATENT DOCUMENTS 3,475,853 A 11/1969 Adler
3,597,878 A 8/1971 Iwasaki et al.
3,650,065 A 3/1972 Johmann
3,672,096 A 6/1972 Johmann
3,726,144 A 4/1973 Klein
3,745,696 A 7/1973 Sapkus et al.
3,754,351 A 8/1973 Glass et al.
3,757,465 A 9/1973 Barlow
3,767,901 A 10/1973 Black et al.
3,769,745 A 11/1973 Crossman
3,784,210 A 1/1974 Fox et al.
3,828,469 A 8/1974 Giroud
3,841,020 A 10/1974 Ryan et al.
3,912,694 A 10/1975 Chiappe et al.
3,916,562 A 11/1975 Burkhart
4,005,545 A 2/1977 Ptaszek et al.
4,073,088 A 2/1978 Beny et al.
4,139,968 A 2/1979 Milner
4,154,120 A 5/1979 Laesser
4,177,589 A 12/1979 Villa
4,207,704 A 6/1980 Akiyama
4,244,141 A 1/1981 Douglas et al.
4,272,918 A * 6/1981 Inoue ..... 446/300
4,294,033 A 10/1981 Terzian et al.
4,305,222 A 12/1981 Terzian et al.
4,308,880 A 1/1982 Graves
4,339,889 A 7/1982 Guerrero et al.
4,356,658 A 11/1982 Goldfarb
4,413,441 A 11/1983 Hunter et al.
4,516,951 A 5/1985 Saigo et al.
4,545,775 A 10/1985 Kim
4,560,363 A 12/1985 Garza et al.
4,639,234 A 1/1987 Atwood
4,698,927 A 10/1987 Yoshiro
4,699,603 A 10/1987 Saigo et al.
4,767,374 A 8/1988 Yang
4,775,352 A 10/1988 Curran et al.
4,802,878 A 2/1989 Terzian et al.
4,805,328 A 2/1989 Mirahem
4,808,142 A 2/1989 Berliner
4,825,136 A 4/1989 Farhat
4,836,465 A 6/1989 May et al.
4,840,602 A 6/1989 Rose
4,869,703 A 9/1989 Ong S.T.
4,900,289 A * 2/1990 May et al. ..... 446/342
4,923,428 A 5/1990 Curran
4,983,890 A 1/1991 Satoh et al.
5,013,276 A 5/1991 Garfinkel
5,074,821 A 12/1991 McKeefery et al.
5,141,464 A 8/1992 Stern et al.
5,158,492 A 10/1992 Rudell et al.
5,181,877 A 1/1993 Perkitny
5,191,615 A 3/1993 Aldava et al.
5,201,683 A 4/1993 Ferri
5,281,143 A 1/1994 Arad et al.
5,364,300 A 11/1994 Jow
5,376,038 A 12/1994 Arad et al.
5,378,189 A 1/1995 Chiu
5,394,766 A 3/1995 Johnson et al.
5,399,115 A 3/1995 Arad et al.
5,413,516 A 5/1995 Lam
5,468,172 A 11/1995 Basile
5,495,151 A 2/1996 Lu
5,520,566 A 5/1996 Lin
5,636,994 A 6/1997 Tong
5,641,317 A 6/1997 Huang
5,679,050 A 10/1997 Llorens
5,733,169 A 3/1998 Tsai
5,791,967 A 8/1998 Yeh
5,820,441 A 10/1998 Pracas
5,833,513 A 11/1998 Llorens
5,855,502 A 1/1999 Truchsess
5,902,169 A 5/1999 Yamakawa
5,975,979 A * 11/1999 Llorens ..... 446/301
6,017,261 A 1/2000 Wachtel
6,022,263 A 2/2000 Liu et al.
6,039,626 A 3/2000 Gerold et al.
6,048,209 A 4/2000 Bailey
6,053,798 A 4/2000 Tang
6,068,536 A 5/2000 Madland et al.
6,110,001 A 8/2000 Chae
6,124,541 A 9/2000 Lu
6,149,490 A 11/2000 Hampton et al.
6,149,491 A 11/2000 Arad et al.
6,186,859 B1 2/2001 Hickman et al.
6,220,923 B1 4/2001 Lin
6,238,262 B1 * 5/2001 Pracas ..... 446/301
6,253,058 B1 6/2001 Murasaki et al.
6,352,464 B1 3/2002 Madland et al.
6,386,942 B1 5/2002 Tang
6,416,380 B1 7/2002 Li-Wen
6,454,626 B1 9/2002 An
6,497,607 B1 12/2002 Hampton et al.
6,503,123 B2 1/2003 Chung
6,514,117 B1 2/2003 Hampton et al.
6,537,128 B1 3/2003 Hampton et al.
6,544,094 B1 4/2003 Maddocks et al.
6,544,098 B1 4/2003 Hampton et al.
6,547,632 B2 4/2003 Marine et al.
6,585,556 B2 7/2003 Smirnov
6,599,166 B2 7/2003 Ellman et al.
6,620,021 B2 9/2003 Liu
6,620,024 B2 9/2003 Choi
6,623,327 B2 9/2003 Marine et al.
6,652,349 B1 11/2003 Wichter
6,682,390 B2 1/2004 Saito
6,682,392 B2 1/2004 Chan
6,692,333 B2 2/2004 Kislevitz et al.
6,733,359 B1 5/2004 Jacobs
6,736,693 B1 5/2004 Lund et al.
6,776,681 B2 8/2004 Willett
6,793,553 B2 9/2004 Willett
6,843,703 B1 1/2005 Iaconis et al.
6,875,074 B1 4/2005 Morris et al.
6,905,390 B2 6/2005 Fukui et al.
6,935,919 B2 8/2005 Fong
6,988,928 B2 1/2006 Willett
6,991,511 B2 1/2006 Maggiore et al.
7,021,988 B2 * 4/2006 Patton ..... 446/337
7,025,655 B2 4/2006 Chase
7,025,657 B2 4/2006 Nishimoto
7,066,782 B1 6/2006 Maddocks et al.
7,118,443 B2 10/2006 Marine et al.
7,189,137 B2 3/2007 Ellman et al.
7,207,859 B1 4/2007 Iaconis et al.
7,234,988 B2 6/2007 Patton
7,234,989 B2 6/2007 Maddocks et al.
7,296,492 B2 11/2007 Marine et al.
7,322,874 B2 1/2008 Ellman et al.
7,364,489 B1 4/2008 Iaconis et al.
7,431,629 B1 10/2008 Maddocks et al.
7,442,107 B1 10/2008 Ueda et al.
7,507,139 B1 3/2009 Maddocks et al.
2001/0053651 A1 12/2001 Wright
2005/0233675 A1 10/2005 Marine et al.
2006/0270312 A1 11/2006 Maddocks et al.
2007/0010163 A1 1/2007 Maddocks et al.
2007/0099538 A1 5/2007 Friedland et al.
2007/0128979 A1 6/2007 Shackelford et al.
2007/0149091 A1 6/2007 Viohl
2007/0254554 A1 11/2007 Ellman et al.
2008/0014831 A1 1/2008 Rettberg et al.
2008/0050999 A1 2/2008 Jang et al.
2008/0153384 A1 6/2008 Friedland et al.
2008/0293324 A1 11/2008 Friedland
2009/0104843 A1 4/2009 Chu et al.

FOREIGN PATENT DOCUMENTS

DE 202004001309 5/2004
EP 0534032 12/1991
EP 0808645 7/2001
EP 1166839 2/2002
EP 1208891 5/2002

(56) References Cited

FOREIGN PATENT DOCUMENTS

| | | |
|---|---|---|
| EP | 1864703 | 12/2007 |
| FR | 2441400 | 6/1980 |
| GB | 2106404 | 4/1983 |
| GB | 2193652 | 2/1988 |
| GB | 2451082 | 1/2009 |
| JP | 1254190 | 10/1989 |
| JP | 6304338 | 11/1994 |
| JP | 06304339 | 11/1994 |
| JP | 08098959 | 4/1996 |
| JP | 10247362 | 9/1998 |
| JP | 2004305237 | 11/2004 |
| JP | 2006289508 | 10/2006 |
| NL | 1018452 | 8/2002 |
| WO | 9613312 | 5/1996 |
| WO | 0035548 | 6/2000 |
| WO | 02064231 | 8/2002 |
| WO | 03099406 | 12/2003 |
| WO | 2005007259 | 1/2005 |
| WO | 2006095718 | 9/2006 |
| WO | 2006095719 | 9/2006 |
| WO | 2007143754 | 12/2007 |

* cited by examiner

TOY FIGURES HAVING MULTIPLE CAM-ACTUATED MOVING PARTS

CROSS-REFERENCE TO RELATED APPLICATIONS

This application claims priority under 35 U.S.C. §119(e) to U.S. Provisional Patent Application Ser. No. 61/253,764 entitled "Toy Figure Having Multiple Cam-Actuated Moving Parts," filed Oct. 21, 2009; and to U.S. Provisional Patent Application Ser. No. 61/250,474 entitled "Toy Figure Having Multiple Cam-Actuated Moving Parts," filed Oct. 9, 2009. The complete disclosures of the above applications are herein incorporated by reference for all purposes.

BACKGROUND OF THE DISCLOSURE

Examples of toys and devices that include cam-actuated moving parts, and which may include multiple movements driven by a single motor, are disclosed in U.S. Pat. No. 7,025,655, U.S. Pat. No. 6,991,511, U.S. Pat. No. 6,988,928, U.S. Pat. No. 6,905,390, U.S. Pat. No. 6,793,553, U.S. Pat. No. 6,692,333, U.S. Pat. No. 6,503,123, U.S. Pat. No. 6,149,491, U.S. Pat. No. 6,149,490, U.S. Pat. No. 5,833,513, U.S. Pat. No. 5,820,441, U.S. Pat. No. 5,413,516, U.S. Pat. No. 5,158,492, U.S. Pat. No. 4,923,428, U.S. Pat. No. 4,900,289, U.S. Pat. No. 4,767,374, U.S. Pat. No. 4,698,927, U.S. Pat. No. 4,413,441, U.S. Pat. No. 4,305,222, U.S. Pat. No. 4,207,704, U.S. Pat. No. 4,139,968, U.S. Pat. No. 4,073,088, U.S. Pat. No. 3,912,694, U.S. Pat. No. 3,745,351, U.S. Pat. No. 3,726,144, U.S. Pat. No. 3,597,878, U.S. Pat. No. 3,298,130, U.S. Pat. No. 3,142,131, U.S. Pat. No. 3,024,535, U.S. Pat. No. 2,996,304, U.S. Pat. No. 2,895,258, U.S. Pat. No. 2,378,190, and U.S. Pat. No. 2,157,889; in Japanese Patent Application Publication No. H06-304339(A) (JP6304339); and in International Publication No. WO02064231. The complete disclosures of the above patents and patent applications are herein incorporated by reference for all purposes.

SUMMARY OF THE DISCLOSURE

The present disclosure is directed to toy figures. The toy figure may, in some embodiments, include a head; plural facial-expression structures movably mounted to the head and configured to move independent of each other; plural cams configured to rotate about a first axis and to move the plural facial-expression structures; and an elongate cam drive configured to rotate about a second axis spaced from the first axis, and to contact and rotate the plural cams about the first axis, the elongate cam drive having a constant outer diameter.

In some embodiments, the toy figure may include a head; plural facial-expression structures movably mounted to the head and configured to move independent of each other; plural cams configured to rotate about a first axis and to move the plural facial-expression structures, the plural cams having a constant outer diameter; a single cam drive configured to rotate about a second axis parallel to the first axis, and to contact and rotate the plural cams about the first axis; and a motor configured to rotate the cam drive about the second axis.

In some embodiments, the toy figure may include a head; plural facial-expression structures pivotably mounted to the head and configured to move independent of each other, the facial-expression structures including one or more eyebrows, one or more eyelids, and one or more eyeballs; plural cams configured to rotate about a first axis and to move the facial-expression structures, the plural cams having a constant outer diameter and including a drive surface and a cam profile surface; plural cam followers configured to connect the plural facial-expression structures and the plural cams; an elongate cam drive configured to rotate about a second axis parallel to the first axis and to contact the drive surface of the plural cams and rotate the plural cams about the first axis, the elongate cam drive having a constant outer diameter; and a motor disposed within the head and configured to rotate the elongate cam drive about the second axis, wherein the plural cam followers are engaged with the cam profile surface of the plural cams and configured to be moved by the cam profile surface of the plural cams.

DETAILED DESCRIPTION OF THE DISCLOSURE

Figure 1:
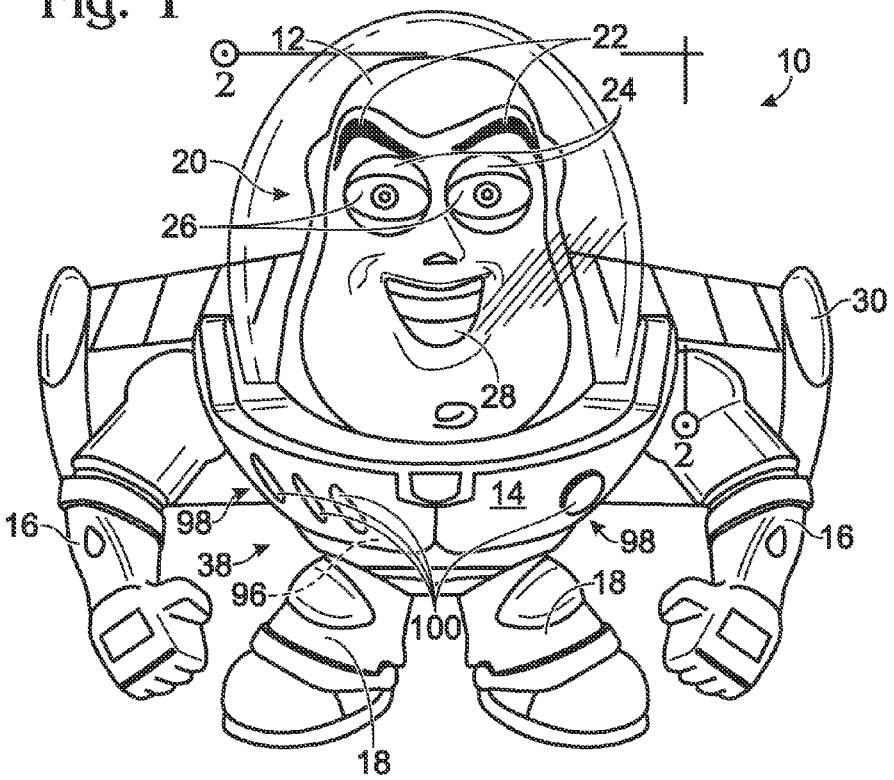
FIG. 1 is a front view of a toy figure having multiple cam-actuated moving parts.

An example of a toy FIG. 10 having multiple cam-actuated moving parts, such as moving facial-expression structures, is shown in FIG. 1. Unless otherwise specified, the toy figure may contain at least one of the structures, components, functionalities, concepts, and/or variations described, illustrated, and/or incorporated herein. The multiple cam-actuated moving parts may be used to simulate a variety of emotions, attitudes, and/or feelings for the toy figure. Examples of emotions, attitudes and/or feelings may include anger, surprise, indifference, happiness, etc.

The toy figure may include a head 12, a body 14, arms 16, and legs 18, as shown in FIG. 1. The head, arms, and/or legs may be movably connected to the body. Toy FIG. 10 also may include one or more plural facial-expression structures 20, such as eyebrows 22, eyelids 24, eyeballs 26, and a mouth 28, as shown in FIG. 1.

The facial-expression structures may be movably mounted to the head, such as slidingly, pivotably, and/or rotatably mounted to the head. Additionally, or alternatively, the plural facial-expression structures may be spaced from each other and/or configured to move independent of each other. Alternatively, two or more of facial-expression structures 22 may be connected to each other and/or move dependent of each other. One or more of the facial-expression structures may move beneath a flexible "skin" of the toy figure. For example, the facial-expression structures may include eyebrow levers that move the skin to make the eyebrows appear to move when those levers are moved by a cam assembly described below.

Although toy FIG. 10 is shown to include facial-expression structures 20, the toy figure may additionally, or alternatively, include other structures movably connected to any suitable portion of the toy figure, such as the head, body, arms, legs, and/or one or more accessories. For example, wings 30 (shown in FIG. 1) may be movably connected to body 14.

Figure 2:
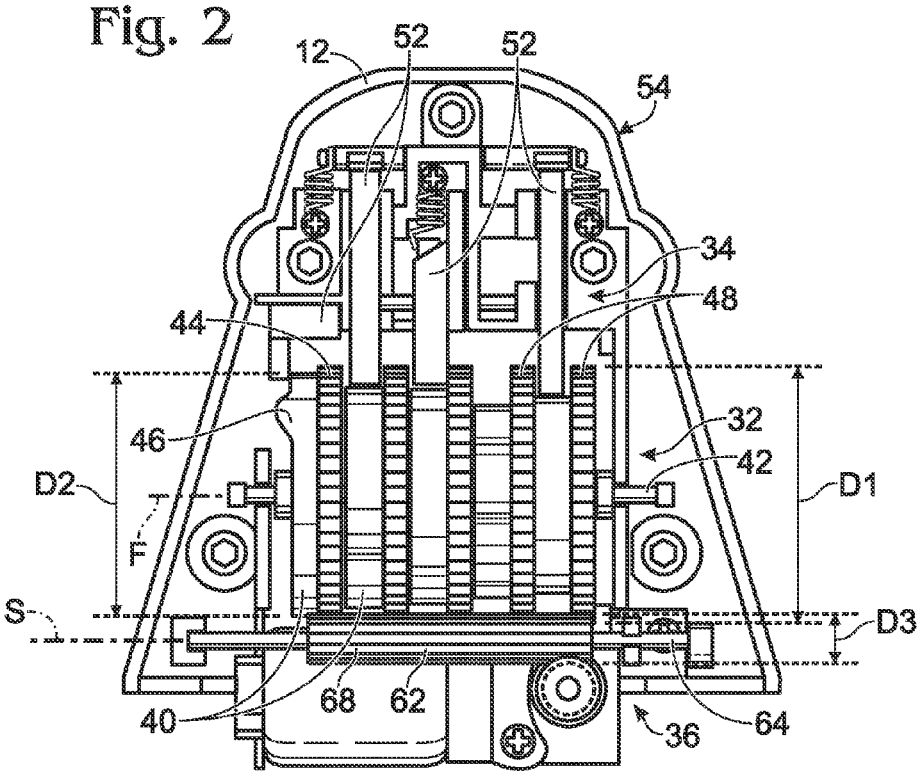
FIG. 2 is a partial sectional view taken along lines 2-2 in FIG. 1 of a head of the toy figure of FIG. 1 showing plural cams.

Toy FIG. 10 may include a cam assembly 32, a cam follower assembly 34, a drive assembly 36, and a controller assembly 38, as shown in FIGS. 1-2. The cam assembly may include any suitable structure configured to move facial-expression structures 20. For example, cam assembly 32 may include plural cams 40 and a cam shaft 42, as shown in FIG. 2. The plural cams may be mounted on the cam shaft and configured to rotate about a first axis F defined by that shaft, and to move the plural facial-expression structures.

Cam assembly 32 may include any suitable number of cams 40. For example, the cam assembly may include five cams. Each of the cams may be configured to move a different facial-expression structure. Alternatively, one or more of the cams may move two or more facial-expression structures. Alternatively, or additionally, two or more cams may move a single facial-expression structure.

Although cam assembly 32 is shown to include five cams 40, the cam assembly may include two, three, four, six, seven, eight, or more cams. Additionally, cams 40 may have any suitable diameters. For example, the cams may have a constant outer diameter. Alternatively, two or more of cams 40 may have different outer diameters from the other cams.

Cams 40 may include a drive surface 44 and a cam profile surface 46, as shown in FIG. 2. The drive surface may be in contact with a cam drive of drive assembly 34 and may include a plurality of surface teeth 48. The teeth may mesh with drive teeth of drive assembly 34. Cam profile surface 46 may be configured to move one or more cam followers of cam follower assembly 36. The cam profile surface may include any suitable combination of shapes (such as valleys, protuberances, etc.) based, at least in part, on the desired movement of the facial-expression structure(s). For example, the cam profile surface may include at least one lobe 50.

The drive and cam profile surfaces may have any suitable outer diameters. For example, the drive surface may have outer diameter D1 and the cam profile surface may have an outer diameter D2. The outer diameter of the cam profile surface may be less than, the same, or greater than the outer diameter of the drive surface. For example, outer diameter D2 may be less than outer diameter D1 for cams 40, as shown in FIG. 2. Alternatively, outer diameter D2 may be the same as outer diameter D1. In either alternative, cams 40 may have an outer diameter that is the same as the outer diameter of the drive surface of the cams. In other words, the outer diameter of cams 40 is the same as outer diameter D1.

Alternatively, outer diameter D2 may be greater than outer diameter D1. In that alternative, cams 40 may have an outer diameter that is the same as the outer diameter of the cam profile surface of the cams. In some embodiments, one or more outer diameters of the cam profile surface of the cams may be the same and/or greater than the outer diameter of the drive surface of those cams. In those embodiments, each of cams 40 may have an outer diameter that is either the outer diameter of its drive surface or the outer diameter of its cam profile surface.

Figure 3:
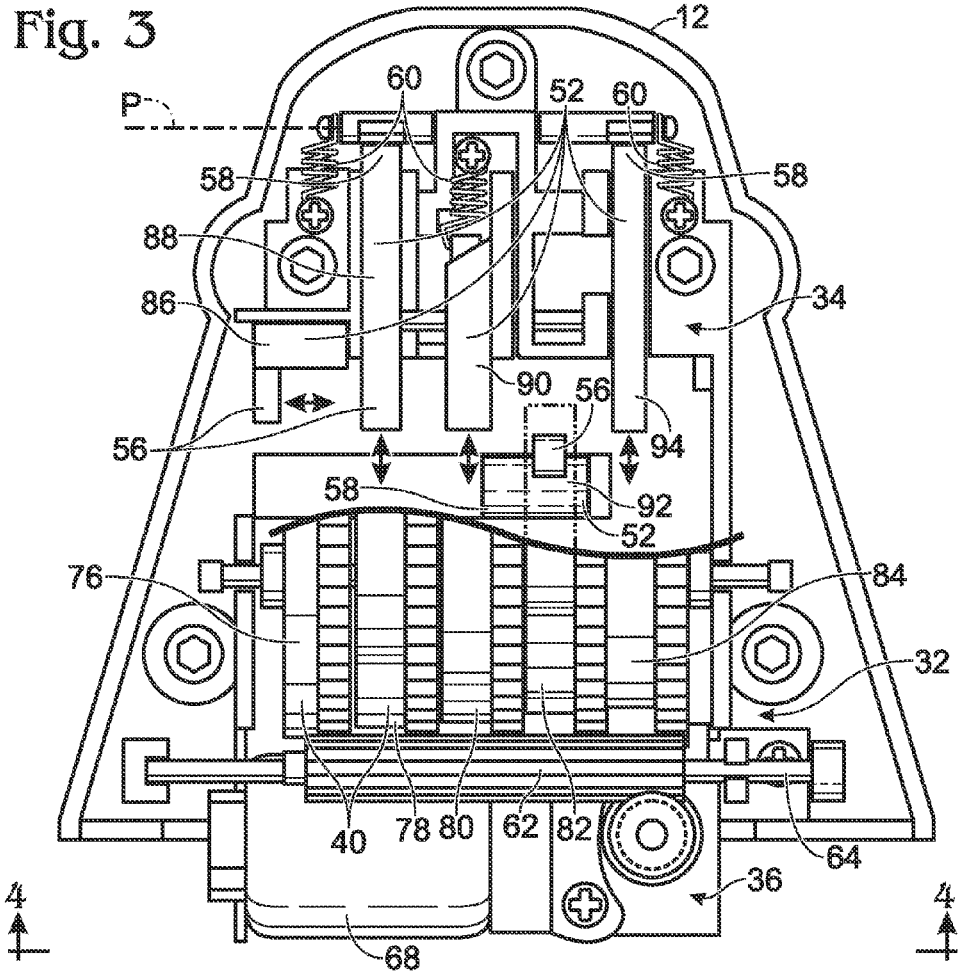
FIG. 3 is the partial sectional view of FIG. 2 shown without portions of the plural cams.

Cam follower assembly 34 may include any suitable structure configured to operatively connect cam assembly 32 and facial-expression structures 20. For example, the cam follower assembly may include plural cam followers 52 and a bias assembly 54, as shown in FIGS. 2-3. The cam followers may be configured to connect the plural facial-expression structures and the plural cams. For example, cam followers 52 may include a first end portion 56 and a second end portion 58, as shown in FIG. 3.

Figures 5, 6:
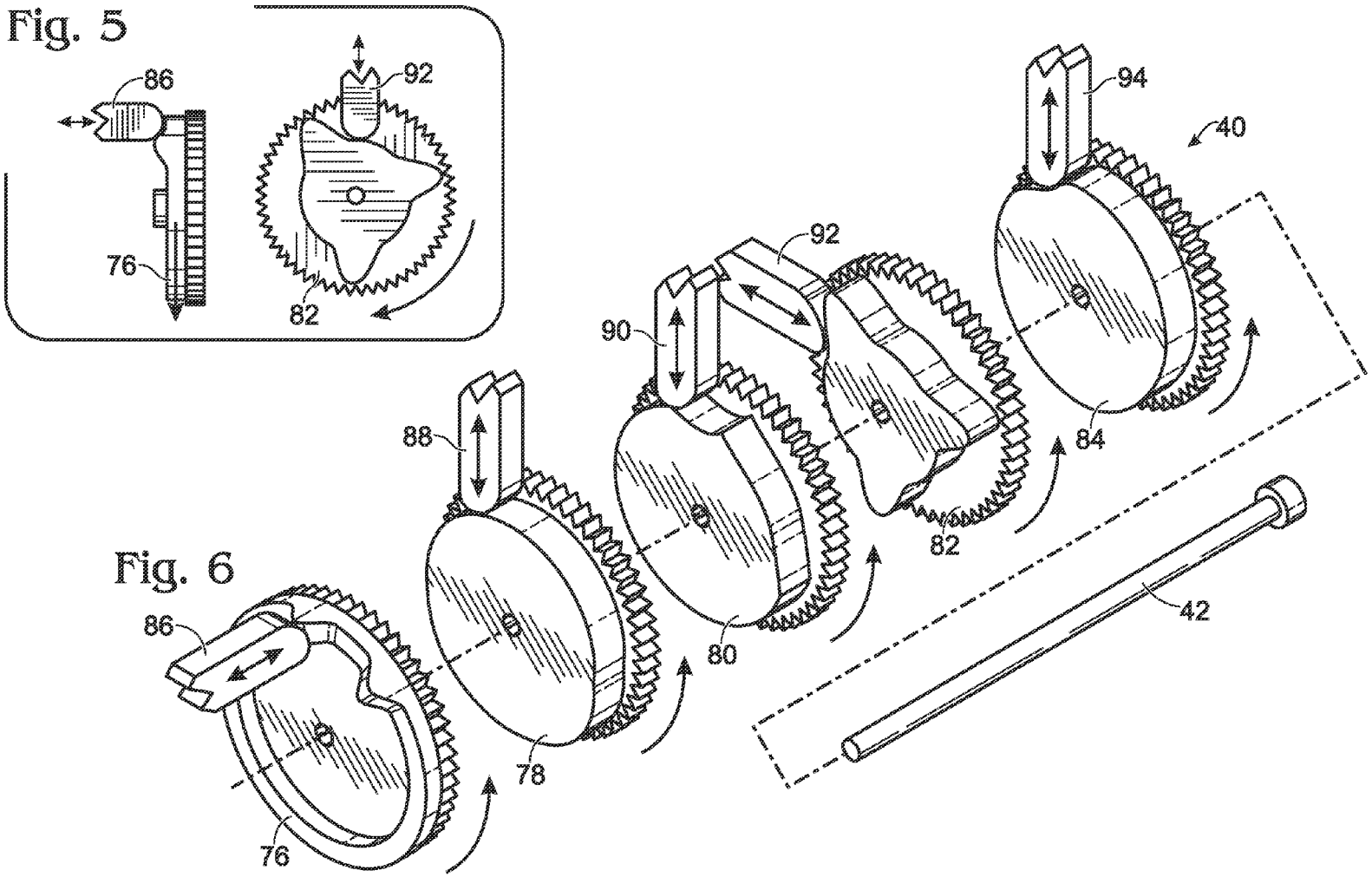
FIG. 5 includes front and side views of cams of the plural cams of FIG. 2.
FIG. 6 is an exploded isometric view of the plural cams of FIG. 2.

The first end portion may be engaged with the cam profile surface, and may be configured to be moved by the cam profile surface of the cams, as shown in FIGS. 5-6. Second end portion 58 may be connected to one or more of the facial-expression structures in any suitable way(s). Cam followers 52 may be configured to pivot about one or more pivot axes P. The pivot axis may be parallel to the first axis, or may have any other suitable relationship with the first axis, such as perpendicular or oblique to the first axis. Alternatively, or additionally, the cam followers may be slid and/or rotated by the cam profile surface of the cams.

Cam follower assembly 34 may include any suitable number of cam followers 52. For example, the cam follower assembly may include a cam follower 52 for each cam 40. In other words, cam follower assembly 34 may include the same number of cam followers as cams. Alternatively, cam follower assembly 34 may include less or more cam followers 52 than cams 40. For example, two cam followers 52 may engage the cam profile surface of the same cam 40 in different areas of that cam.

Bias assembly 54 may include one or more bias elements 60 configured to urge one or more of the cam followers into engagement with the cam profile surface of the plural cams, as shown in FIGS. 2-3. For example, bias elements 60 may urge cam followers 52 toward cam profile surface 46. Bias elements may include coil springs, leaf springs, and/or musical wire.

Any suitable number of the cam followers may be connected to one or more of the bias elements. For example, three of the cam followers may be each connected to a different bias element 60, as shown in FIGS. 2-3. Alternatively, more or fewer of the cam followers (such as one, two, four, or five) may be connected. In some embodiments, a bias element 60 may be connected to two or more of the cam followers. The cam assembly and cam follower assemblies may sometimes be referred to as a "cam-based actuating mechanism."

Cams 40 and cam followers 52 of the cam-based actuating mechanism may be configured to be connected to any suitable combination of facial-expression structures 20. For example, cams 40 may include first cam 76, second cam 78, third cam 80, fourth cam 82, and fifth cam 84. Cam followers 52 may include first cam follower 86, second cam follower 88, third cam follower 90, fourth cam follower 92, and fifth cam follower 94, as shown in FIGS. 5-6.

Figure 7:
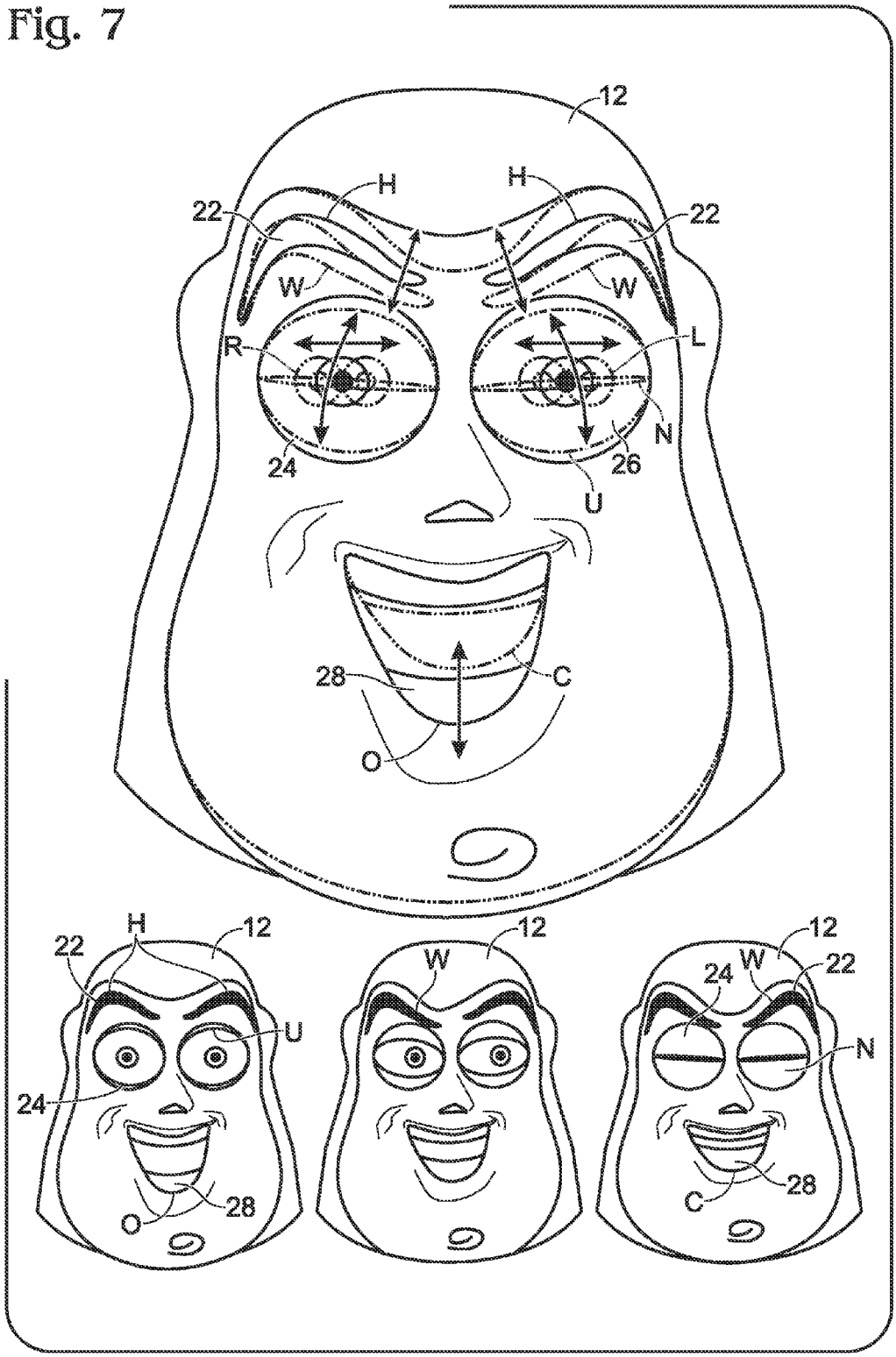
FIG. 7 includes partial views of the toy figure of FIG. 1 showing movement of facial-expression structures.

Referring to FIG. 7, the first cam and cam follower combination may be configured to move, for example, eyeballs 26 between any suitable positions, such as between a left position L and a right position R. The second cam and cam follower combination may be configured to move, for example, a first eyebrow 22 between any suitable positions, such as between a high position H and a low position W. The third cam and cam follower combination may be configured to move, for example, one or more eyelids 24 between any suitable positions, such as between an up position U and a down position N. The fourth cam and cam follower combination may be configured to move, for example, mouth 28, between any suitable positions, such as between an open position O and a closed position C (or between narrow open and wide open positions). The fifth cam and cam follower combination may be configured to move, for example, a second eyebrow 22 between any suitable positions, such as between high position H and low position W.

One or more of the above cam and cam follower combinations may provide movement of one or more facial expression structures along a full range between the above described positions or among one or more discrete positions between those positions. For example, the first cam and cam follower combination may move the eyeballs along a full range between the left and right positions, or may move the eyeballs to one or more center positions (and/or other positions) between the left and right positions.

Figure 4:
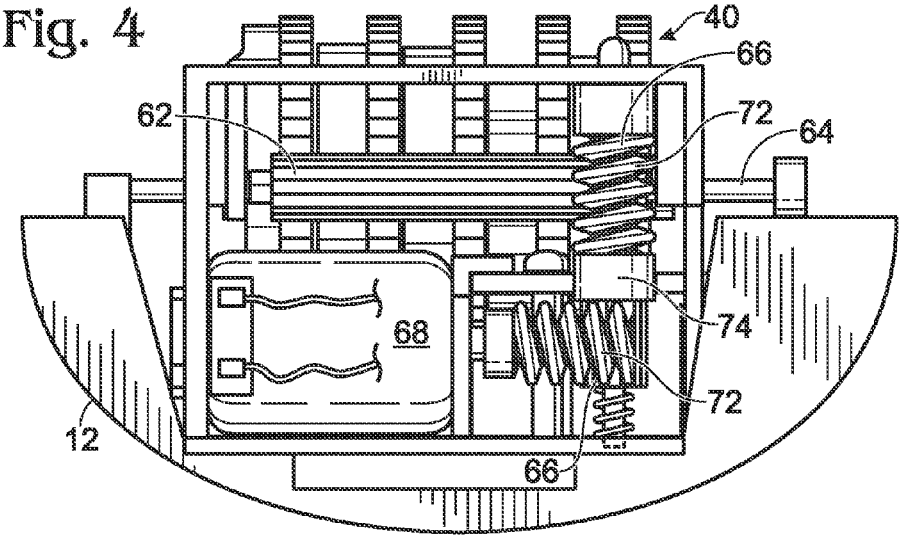
FIG. 4 is a bottom view of the head of FIG. 2.

Drive assembly 36 may include any suitable structure configured to move cams 40. For example, the drive assembly may include a cam drive 62, a drive shaft 64, drive gears 66, and a motor 68, as shown in FIGS. 2-4. The cam drive may be mounted on drive shaft 64. Cam drive 62 may be configured to rotate about a second axis S defined by that shaft, and to contact and rotate plural cams 38 about the first axis. First axis F may have any suitable relationship with second axis S, such as parallel, perpendicular, oblique, etc. For example, first axis F may be spaced from and/or parallel to second axis S.

Cam drive 62 may be a single cam drive or may include multiple components. Additionally, the cam drive may be any suitable shape(s). For example, the cam drive may be elongate and/or may have a constant outer diameter D3. In some embodiments, the constant outer diameter of plural cams 38 may be larger than the constant outer diameter of cam drive 62. The cam drive may include a plurality of drive teeth 68 that may be meshed with the plurality of surface teeth of one or more of the cams, as shown in FIGS. 2-4.

Drive gears 66 may include any suitable structure configured to operatively connect motor 68 and cam drive 62. For example, drive gears 66 may include one or more worm gears 72, as shown in FIG. 4. Motor 68 may be configured to rotate cam drive 62 about the second axis via drive gears 66. The motor may be configured to rotate the cam drive in clockwise and/or counter-clockwise directions (and/or forward and/or reverse directions).

In some embodiments, drive assembly 34 may include a torque limiter or clutch 74, as shown in FIG. 4. The clutch may be configured to isolate at least a part of the drive assembly from damage, such as damage that may be caused by externally caused motions of the facial-expression structures. Clutch 74 may include friction-based, toothed, and/or castellated clutches. The cam assembly, cam follower assembly, and/or drive assembly may be disposed within head 12.

Controller assembly 38 may include any suitable structure configured to selectively control drive assembly 34. For example, controller assembly 38 may include a controller 96 and a user interface 98, as shown in FIG. 1. The controller may control motor 68 to selectively rotate cam drive 62 based, at least in part, on one or more inputs from the user interface. For example, the controller may control the motor to rotate cam drive in a clockwise or counter-clockwise direction based, at least in part, on one or more of those inputs.

User interface 98 may include any suitable structure configured to be manipulated by a user, such as one or more buttons 100 shown in FIG. 1. The user interface may include any suitable number of buttons 100, such as one, two, three, four, or five buttons. Additionally, or alternatively, user interface 98 may include one or more levers, pull cords, switches, etc.

In some embodiments, controller assembly 38 may include one or more sensors (not shown) configured to enable and/or prevent certain movements and/or movement sequences of the cam-based actuated mechanism. The sensors may be position-, orientation-, and/or motion-based sensors and may provide one or more inputs to the controller. The controller may be configured to cause the motor to rotate the cam drive to a predetermined rotational position (and/or sequentially rotate the cam drive to a predetermined sequence of a plurality of predetermined rotational positions) based on those inputs and/or inputs received from the user interface.

For example, the sensor may provide inputs to the controller regarding the position of the cams and/or facial-expression structures allowing the controller to move those facial-expression structures to the predetermined position(s) and/or sequence based on the input(s) received from the user interface. In some embodiments, controller assembly 38 may include a zeroing or centering mechanism (not shown) configured to return the facial-expression structures to one or more predetermined positions after those structures are moved.

Toy FIG. 10 may additionally, or alternatively, include one or more other assemblies, such as an audiovisual assembly (not shown) configured to generate one or more audio outputs and/or one or more visual outputs. The audio outputs may include, for example, verbal output and/or sound effects. The visual outputs may include, for example, illumination of one or more lamps or light-emitting diodes. Controller 96 may be configured to control the audiovisual assembly to synchronize the audio and/or visual outputs with movement of the facial-expression structures and/or other moving parts. For example, the controller may control the drive assembly and audiovisual assembly to generate facial-expression structure movements and audio and/or visual outputs based on which button 100 the user has pressed.

It is believed that the disclosure set forth herein encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the disclosure includes all novel and non-obvious combinations and subcombinations of the various elements, features, functions and/or properties disclosed herein.

Applicant reserves the right to submit claims directed to certain combinations and subcombinations that are directed to one of the disclosed inventions and are believed to be novel and non-obvious. Inventions embodied in other combinations and subcombinations of features, functions, elements and/or properties may be claimed through amendment of those claims or presentation of new claims in that or a related application. Such amended or new claims, whether they are directed to a different invention or directed to the same invention, whether different, broader, narrower or equal in scope to the original claims, are also regarded as included within the subject matter of the inventions of the present disclosure. Where such claims recite "a" or "a first" element or the equivalent thereof, such claims should be understood to include incorporation of one or more such elements, neither requiring nor excluding two or more such elements.

What is claimed is:

1. A toy figure, comprising:

a head;

plural facial-expression structures movably mounted to the head and configured to move independent of each other;

plural cams configured to rotate about a first axis and to move the plural facial-expression structures; and an elongate cam drive configured to rotate about a second axis spaced from the first axis, and to contact and to rotate the plural cams about the first axis, the elongate cam drive having a constant outer diameter.

2. The toy figure of claim 1, wherein the plural cams include a drive surface, the elongate cam drive being configured to contact the drive surface of the plural cams and rotate the plural cams about the first axis.

3. The toy figure of claim 2, wherein the drive surface includes a plurality of surface teeth and the elongate cam drive includes a plurality of drive teeth that are meshed with the plurality of surface teeth.

4. The toy figure of claim 1, further comprising plural cam followers configured to connect the plural facial-expression structures and the plural cams, wherein the plural cams include a cam profile surface, the plural cam followers engaged with the cam profile surface and configured to be moved by the cam profile surface of the plural cams.

5. The toy figure of claim 4, further comprising a bias assembly configured to urge the plural cam followers into engagement with the cam profile surface of the plural cams.

6. The toy figure of claim 4, wherein the plural cam followers pivot about one or more pivot axes parallel to the first axis.

7. The toy figure of claim 4, wherein the cam profile surface of one or more of the plural cams includes at least one lobe.

8. The toy figure of claim 1, wherein the plural facial-expression structures include one or more eyebrows configured to move between high and low positions.

9. The toy figure of claim 8, wherein the plural facial-expression structures include one or more eyelids configured to move between up and down positions.

10. The toy figure of claim 9, wherein the plural facial-expression structures include one or more eyeballs configured to move between left and right positions.

11. The toy figure of claim 10, wherein the plural facial-expression structures include a mouth configured to move between open and closed positions.

12. The toy figure of claim 1, wherein the first axis is parallel to the second axis.

13. A toy figure, comprising:

a head;

plural facial-expression structures movably mounted to the head and configured to move independent of each other;

plural cams configured to rotate about a first axis and to move the plural facial-expression structures, the plural cams having a constant outer diameter;

a single cam drive configured to rotate about a second axis parallel to the first axis, and to contact and rotate the plural cams about the first axis; and a motor configured to rotate the cam drive about the second axis.

14. The toy figure of claim 13, wherein the plural cams include a drive surface, the single cam drive being configured to contact the drive surface of the plural cams and rotate the plural cams about the first axis.

15. The toy figure of claim 14, further comprising plural cam followers configured to connect the plural facial-expression structures and the plural cams, wherein the plural cams include a cam profile surface, the plural cam followers engaged with the cam profile surface and configured to be moved by the cam profile surface of the plural cams.

16. The toy figure of claim 15, wherein an outer diameter of the cam profile surface is less than an outer diameter of the drive surface.

17. A toy figure, comprising:

a head;

plural facial-expression structures pivotably mounted to the head and configured to move independent of each other, the facial-expression structures including one or more eyebrows, one or more eyelids, and one or more eyeballs;

plural cams configured to rotate about a first axis and to move the facial-expression structures, the plural cams having a constant outer diameter and including a drive surface and a cam profile surface;

plural cam followers configured to connect the plural facial-expression structures and the plural cams;

an elongate cam drive configured to rotate about a second axis parallel to the first axis and to contact the drive surface of the plural cams and rotate the plural cams about the first axis, the elongate cam drive having a constant outer diameter; and a motor disposed within the head and configured to rotate the elongate cam drive about the second axis, wherein the plural cam followers are engaged with the cam profile surface of the plural cams and configured to be moved by the cam profile surface of the plural cams.

18. The toy figure of claim 17, wherein the plural facial-expressions structures further include a mouth.

19. The toy figure of claim 17, further comprising a controller configured to control the motor to selectively rotate the elongate cam drive.

20. The toy figure of claim 17, wherein the constant outer diameter of the plural cams is greater than the constant outer diameter of the elongate cam drive.

21. The toy figure of claim 1, wherein the elongate cam drive is further configured to be in constant contact with the plural cams.

22. The toy figure of claim 13, wherein the plural cams are further configured to rotate about a cam shaft defining the first axis.

* * * * *